US006346135B1

(12) United States Patent
King et al.

(10) Patent No.: US 6,346,135 B1
(45) **Date of Patent: *Feb. 12, 2002**

(54) CORED WIRE FOR TREATING MOLTEN METAL

(75) Inventors: Phillip Ronald King, Winsted, CT (US); Richard Shaddinger Baum, Allentown, PA (US)

(73) Assignee: Minerals Technologies Inc., Bethlehem, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/209,517

(22) Filed: Dec. 10, 1998

(51) Int. Cl.[7] ..... C22B 9/02
(52) U.S. Cl. ..... 75/304; 75/526
(58) Field of Search ..... 75/304, 526

(56) References Cited

U.S. PATENT DOCUMENTS

| | | | | | |
|---|---|---|---|---|---|
| 3,777,361 | A | * | 12/1973 | Fuchs, Jr. | 29/470.6 |
| 3,915,693 | A | | 10/1975 | Rasmussen | |
| 4,035,892 | A | | 7/1977 | Ototani et al. | |
| 4,094,666 | A | | 6/1978 | Ototani | |
| 4,097,268 | A | | 6/1978 | Ototani et al. | |
| 4,134,196 | A | * | 1/1979 | Yamaji et al. | 75/304 |
| 4,174,962 | A | * | 11/1979 | Frantzreb, Sr. et al. | 75/304 |
| 4,481,032 | A | | 11/1984 | Kaiser | |
| 4,512,800 | A | | 4/1985 | Wirth, Jr. | |
| 4,671,820 | A | | 6/1987 | Ototani et al. | |
| 4,698,095 | A | | 10/1987 | Ototani et al. | |
| 4,705,261 | A | | 11/1987 | Wirth, Jr. | |
| 4,832,742 | A | * | 5/1989 | Ototani | 75/304 |
| 5,467,517 | A | * | 11/1995 | Sugito et al. | 29/407 |
| 6,053,960 | A | * | 4/2000 | King et al. | 75/375 |

FOREIGN PATENT DOCUMENTS

| | | | | |
|---|---|---|---|---|
| JP | 53-10315 | * | 1/1978 | 75/304 |
| JP | 53-55407 | | 5/1978 | |

OTHER PUBLICATIONS

B. Bergmann, et al., "Castability Assurance of Al–Killed Si–Free Steel by Calcium Cored Wire Treatment," Vortrag 1st European Conference, Sep. 23, 1991.

N. Bannenberg, et al., "Melting Behaviour of Cored Wire During Injection," Vortrag 6th International Conference, Scaninject VI, Jun. 2, 1992.

* cited by examiner

*Primary Examiner*—Melvyn Andrews
(74) *Attorney, Agent, or Firm*—Marvin J. Powell; Ratner & Prestia

(57) ABSTRACT

A cored wire consisting of an inner calcium wire surrounded by an aluminum sheath forming a composite core which in turn is encased in a steel jacket. The cored wire is formed continuously by covering an extruded calcium wire with aluminum then inserting the aluminum covered calcium wire into a steel jacket in a roll forming process. Also disclosed is a method of reducing splashing when introducing calcium metal into a molten ferrous metal bath.

6 Claims, 3 Drawing Sheets

CORED WIRE FOR TREATING MOLTEN METAL

BACKGROUND OF THE INVENTION

The present invention pertains to cored wires for treating molten metals to remove unwanted impurities and, in particular, to the manufacture and use of cored wires having a reactive metal core.

The beneficial aspects of calcium addition to steel have been well known for the purposes of inclusion modification. Various techniques have been used to introduce the calcium into the molten steel bath in a cost effective manner including the addition of bulk alloy such as calcium silicon, the powder injection of various alloys and mixtures of calcium metals and the use of wires containing mixtures of calcium and other powders. These techniques have been successful in many instances and the usage of calcium and calcium alloys have become common practice in the manufacture of ferrous metals.

Cored wires, in particular a calcium core surrounded by a steel sheath or jacket, have found wide application in the treating of molten ferrous metals. The cored wire is used to introduce calcium into the molten ferrous metal, after the metal is tapped from a furnace, in order to reduce unwanted elements such as sulfur and oxygen in the molten bath and to control the size and shape of inclusions in the solidified metal. A detailed discussion of the overall process of using such wire is contained in U.S. Pat. No. 4,481,032, the specification of which is incorporated herein by reference.

However, due to the metallurgical properties of calcium, including a high vapor pressure and low melting and boiling points, addition of calcium to a molten steel bath presents problems. Powder injection of calcium powder or alloys of calcium mixed with various fluxes and other materials is practiced in some plants but the technology is expensive, the results are inconsistent and the equipment requires a significant amount of space in the users plant. Furthermore, powder injection of calcium is difficult to apply in a cost effective manner.

In order to overcome the problems with the use of calcium powder the steel clad solid calcium cored wire was developed as a solution to the problems encountered by powder injection. U.S. Pat. Nos. 4,035,892, 4,097,268 and 3,915,693 provide a good background discussion of the use of cored wires wherein a granular material or a mixture of granular materials such as calcium and silicon are encased in a steel wire in order to introduce the calcium or calcium silicon into the molten ferrous metal bath. The calcium can be injected into the molten bath as a surface fed wire or by injection through a gas purged refractory lance such as discussed in the '032 patent noted above and U.S. Pat. Nos. 4,705,261 and 4,512,800. With these techniques the calcium core is either a solid metallic calcium rod, calcium particles or a mixture of calcium particles with varying amounts of iron powder and/or aluminum powder.

The aluminum powder is added to reduce the vapor pressure of the calcium metal resulting in a more reproducible calcium recovery and less reactivity and splashing when the mixture is added to the steel. However, when using a particulate core, even with a mixture of aluminum powder and calcium, problems still exist. Due to the hydroscopic and reactive nature of metallic calcium it has a limited shelf life and is prone to surface oxidation. In addition powdered metals are dangerous to handle, and the filling of the steel jacket is prone to non-uniform fill rates due to different powder diameters and morphologies, resulting in wire that is expensive to make and difficult to use.

In one method of manufacture, a calcium metal core is extruded into an elongated shape or wire which has a generally cylindrical cross-sectional shape. The core wire is inserted into a metallic sheath or jacket, e.g. steel, the sheath formed as it is continuously roll formed into a tube. The tube is formed with a mechanical lock seam so that reactive metal, e.g. calcium, is encapsulated or locked inside. The resulting structure or product is a continuous tube or wire, being a composite of a reactive core and a roll formed metallic sheath, or jacket. One of the problems with the prior art roll forming process was the insertion of the core into the metallic sheath during the roll forming process. This problem has been addressed in co-pending U.S. patent application Ser. No. 09/000,990 filed Dec. 30, 1997, the specification which is incorporated herein by reference.

SUMMARY OF THE INVENTION

Thus in its broadest aspect the present invention relates to fabrication of a cored wire for introducing reactive metals into a molten metal bath by fabricating the cored wire with an outer jacket having a higher melting point than an inner core material, the inner core material being a composite of a first reactive metal surrounded by a sheath of a second reactive metal, the first and second reactive metals melting at lower temperatures than the outer jacket to form an alloy prior to melting of the outer jacket. The composite inner core can include a third layer of yet another reactive metal or a composite of two or more reactive or reactive and non-reactive metals as the second layer.

It has been discovered that encapsulating a solid calcium rod or wire in an aluminum jacket prior to insertion into the steel jacket or sheath results in an improved cored wire and an improved method of introducing the wire into a molten ferrous metal bath. Therefore, in one aspect the present invention is a cored wire for introducing calcium and aluminum into a bath of molten metal produced by: extruding the calcium metal into an elongated wire having a generally cylindrical shape; covering the calcium wire with a sheath of aluminum to form a composite core wire; and inserting the composite core wire into a steel jacket.

In another aspect the present invention is a method of treating molten ferrous metal with calcium metal comprising the steps of: providing a cored wire consisting essentially of an inner core of calcium wire surrounded by a jacket of aluminum, to form a component wire core which is covered by a steel jacket; and introducing the cored wire as a continuous structure into a bath of molten ferrous metal until a desired weight of calcium has been introduced into the molten ferrous metal.

In yet another aspect the present invention is a method for reducing splashing and reactivity of calcium metal when introduced into a bath of molten ferrous metal as a calcium wire surrounded by a steel jacket comprising; the step of forming a core composite of calcium wire covered with a jacket of aluminum, followed by insertion of the core composite into the steel jacket.

DETAILED DESCRIPTION OF THE INVENTION

As disclosed in U.S. Pat. No. 4,481,032 a cored wire containing calcium metal and the core is used to introduce calcium metal into a bath of molten metal, e.g., a molten steel bath for the purposes of deoxidation, desulfurization and control of inclusions. The cored calcium wire overcomes problems of trying to introduce particulate calcium into a molten bath, especially since the calcium metal has a much lower density than the molten steel and tends to float rapidly to the surface of the molten bath without reacting.

As set forth in co-pending application Ser. No. 09/000,990 filed Dec. 30, 1997, the incorporation of calcium metal into a metallic sheath in the form of a continuous cored wire was a solution to the problem of using calcium powder encapsulated in the metallic sheath. However, the use of the solid calcium metal cored wire still presents a problem because of the high reactivity of the calcium when it is added to the steel. Reactivity is a problem because the vapor pressure of pure calcium when added to a molten steel bath is approximately 1.7 atmospheres at 1600° C. (2912° F.). Because of the high vapor pressure and low boiling temperature of pure calcium a large amount of calcium vapor is generated when calcium is added to the steel. The calcium vapor creates reactivity and splashing of the steel at the surface of the ladle. This reactivity creates a particular problem in ladles where there is insufficient free board, i.e. distance between the surface of the steel near the top of ladle and the top edge of the ladle. The excessive reactivity and splashing of steel can be severe enough to throw slag and steel out of the ladle resulting in operational problems for the steelmaker.

Thus, it has been discovered that by taking a solid calcium metal core surrounding it with a cover, jacket, or sheath of an aluminum strip, the core and aluminum strip forming a composite core encased in a mild steel sheath, the reactivity of calcium is significantly reduced when it is added to the molten steel bath. The combination of aluminum with calcium results in an alloy with a vapor pressure that is less than that of pure calcium. The composite cored wire of the present invention permits aluminum which melts at 660° C. (1148° F.) and calcium which melts at 850° C. (1562° F.) to alloy prior to the melting of the steel jacket which has a melting temperature of approximately 1537° C. (2798° F.).

Figure 1:
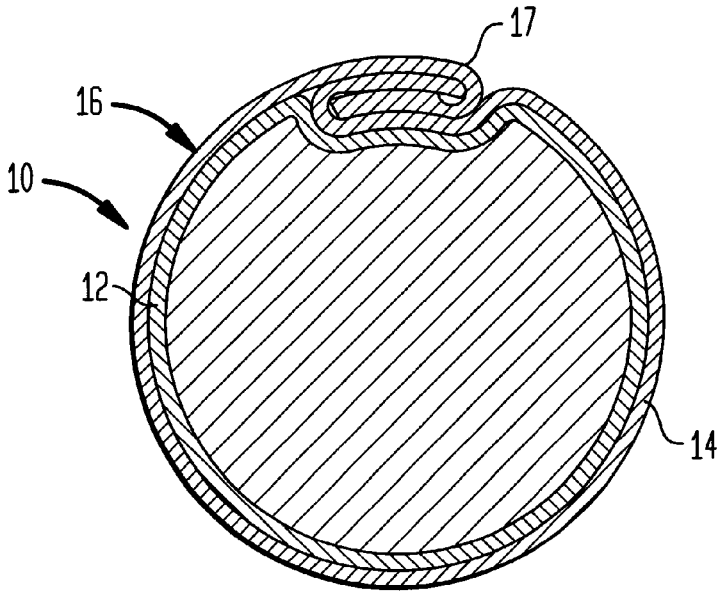
FIG. 1 is a cross-section of a cored wire produced according to the present invention illustrating a lock seam method of closure of the outer jacket or sheath.

Referring to FIG. 1, there is shown a cross-section of a cored wire 10 which comprises an inner core wire 12 surrounded by a sheath of a different reactive metal 14, the inner core wire 12 and the sheath 14 encased in an outer jacket 16. The inner core wire 12 can be of any reactive metal, for example calcium. The metal surrounding the inner core wire 12 can be of 10 another reactive metal, for example aluminum. The solid inner core wire 12 and surrounding sheath 14 form what is referred to as a composite core for the cored wire 10. The outer sheath 16 is continuously formed around the composite core (12, 14,) using a roll forming mill manufactured and sold by Yoder Kransy Kaplan Corporation of Cleveland, Ohio. The roll forming process is a multi-step process that starts with a flat steel strip and gradually roll forms it into the shape shown in FIG. 1. The steel strip is formed into a generally cylindrical shape and closed using a lock seam 17 formed by folding extensions of the peripheral surfaces of the strip as is well known in the art. The lock seam is illustrated at 17 in FIG. 1.

Figure 2:
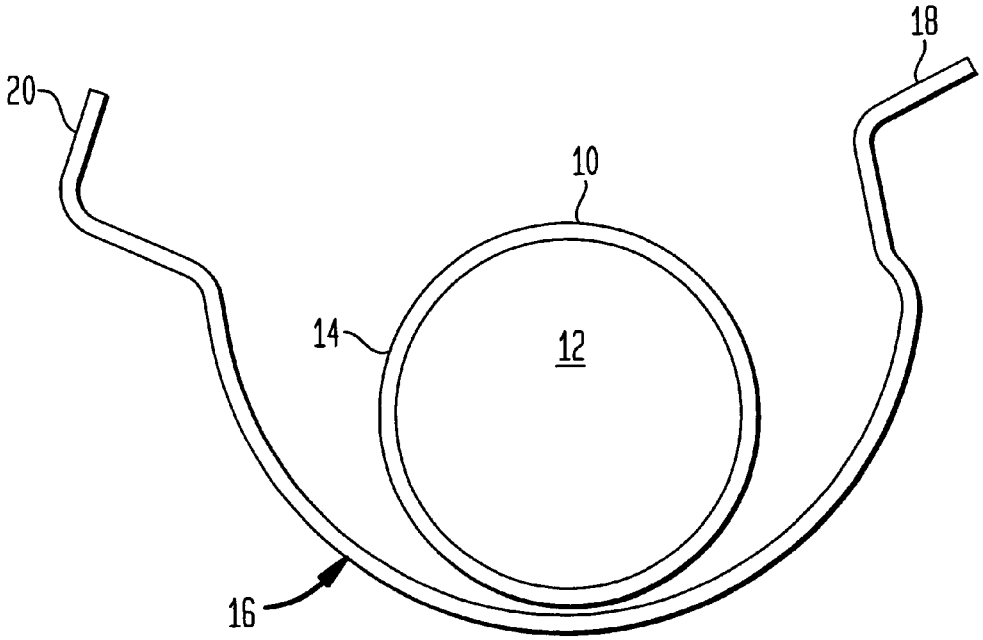
FIG. 2 is a cross-section showing the step in the roll forming process of the sheath where a reactive metal core composite is inserted into the sheath during the roll forming process.

For example, FIG. 2 illustrates one step in the roll forming process wherein the jacket 16 has a trough like configuration with peripheral ends 18 and 20 roll formed to the shape that will eventually form the lock seam. The solid inner core wire 12 is continuously extruded and then introduced into a die through which the extruded wire which becomes solid inner cord wire 12 and the sheath 14 which is in the form of a strip are pulled through the die to form the composite core, as is well known in the art, thus the composite core is a tube of the sheath 14 surrounding the solid inner core wire 12. In one embodiment the solid inner core wire 12 is calcium and the covering or sheath 14 is aluminum. Prior to the step shown in FIG. 2, where the composite core (12, 14) is inserted into the partially roll formed jacket 16, the jacket is formed in a multi step roll forming process to the shape shown. Thereafter the composite core (12, 14) and the sheath 16 continue through successive roll forming steps to achieve the wire with a cross-sectional configuration as shown in FIG. 1.

Figure 3A:
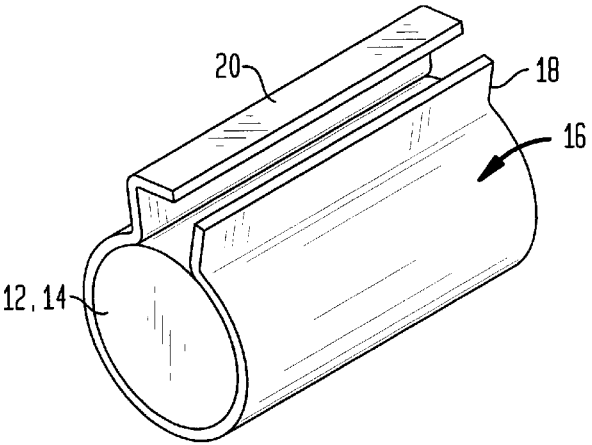
FIGS. 3*a,* 3*b* and 3*c,* show respectively a perspective view, cross-sectional view and longitudinal representation of a first step in a closure of the sheath around the core composite.
Figure 3B:
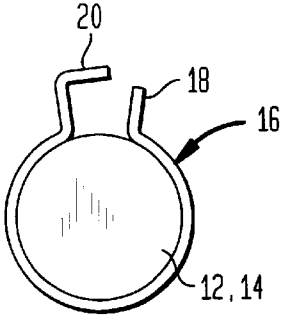
Figure 4A:
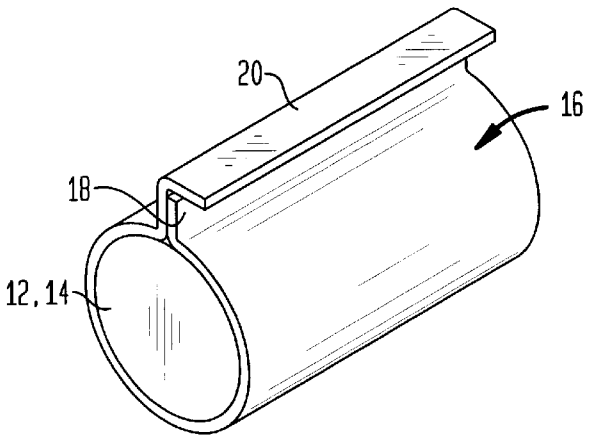
FIGS. 4*a,* 4*b,* and 4*c,* show a perspective view, cross-sectional view and side elevational view of a further step in the formation of the cored wire according to the present invention.
Figure 4B:
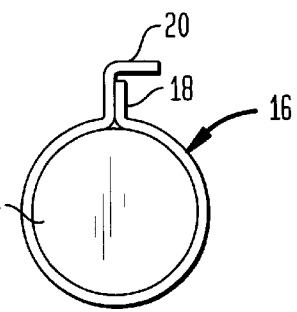
Figure 4C:
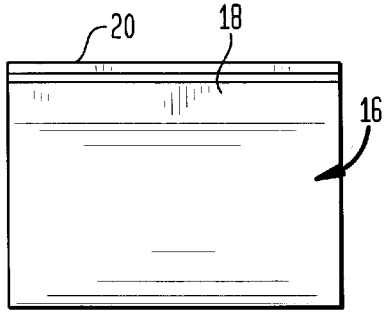
Figure 5A:
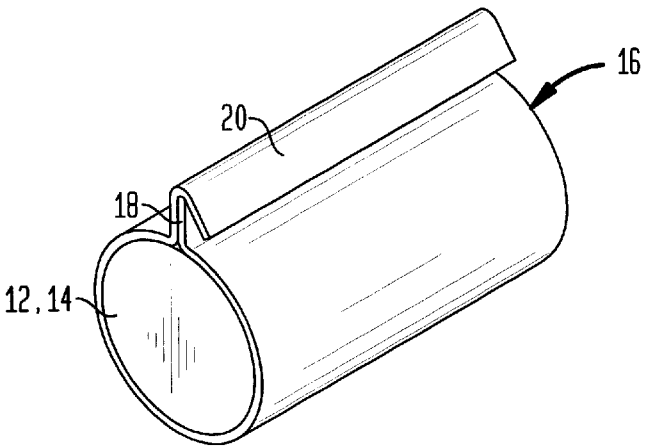
FIGS. 5*a,* 5*b* and 5*c,* show a perspective, cross-sectional view, and elevational view of the succeeding step in the formation of the closure of the lock seam.
Figure 5B:
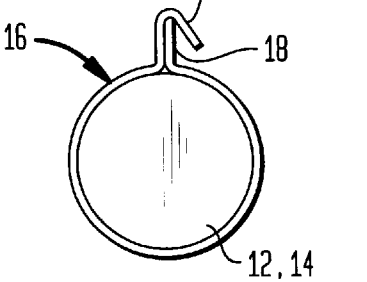
Figure 5C:
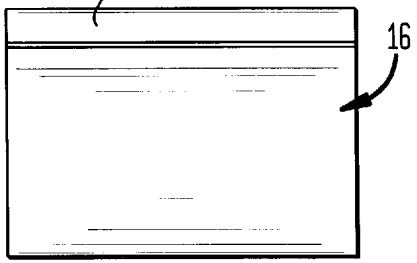

Referring to FIGS. 3*a* and 3*b,* the sheath 16 is shown at a step subsequent to the step shown in FIG. 2 wherein the peripheral edges 18 and 20 are being brought together so that the vertical portions of the peripheral surfaces can be mated together as shown in FIGS. 4*a* and 4*b*. Peripheral portion 20 has an extended surface portion which is bent at a right angle, to overlay peripheral portion 18 as shown in FIGS. 4*a* and 4*b* at this stage of the roll forming process. As shown in FIGS. 5*a* and 5*b* the overlying portion of peripheral surface 20 is belt bent at an angle that is approximately 45° to vertical or 45° to the mating surfaces of the vertical portions of peripheral portions 18 and 20.

Figure 6A:
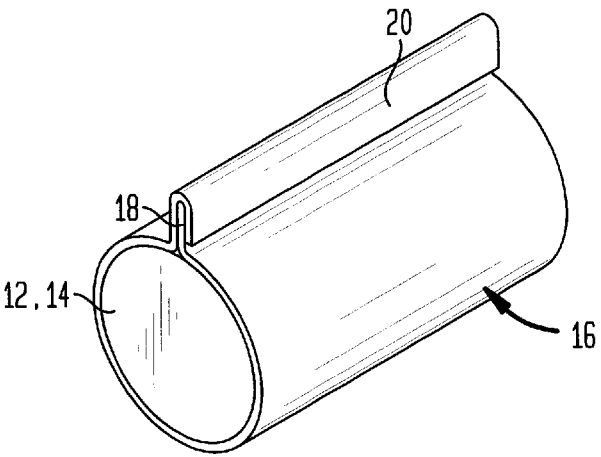
FIGS. 6*a,* 6*b* and 6*c* show a perspective cross-sectional view and side elevational view of a further step in the closure of the lock seam according to the present invention.
Figure 6B:
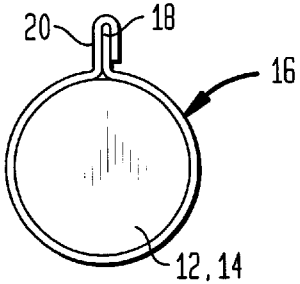
Figure 6C:
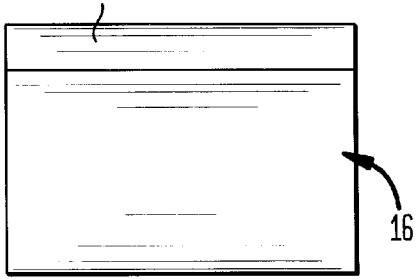

FIGS. 6*a* and 6*b* show the next step where the overlying portion of peripheral section 20 is folded completely over the vertical portion of peripheral extension 18. Thereafter successive roll forming stages fold the vertical portions over and produce the generally cylindrical shape as shown in FIG. 1.

Figure 3C:
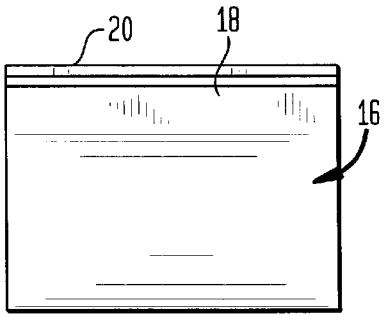

FIGS. 3*c,* 4*c,* 5*c* and 6*c* are elevational views showing the surfaces as they are brought together for folding or crimping to form an elongated cored wire.

A cored wire according to the present invention, when used to form a calcium aluminum wire for treating molten ferrous metal, can be fabricated with a composite core having a calcium content, by weight per unit length, of between 10% and 90%, balance aluminum. A calcium content higher than 90% in the composite core results in insufficient aluminum present to reduce the reactivity of calcium while a calcium content less than 10% results in insufficient calcium to achieve the desired metallurgical result in the finished or solidified steel or ferrous metal. A preferred composition is a composite core having a calcium content of, by weight per unit length, of between 73% and 77%, balance aluminum.

For the cored wire, the outer jacket or sheath 16 can be present in an amount of, by weight per unit length, between 15 and 85% of the total wire weight. A preferred composition is between 45 to 55% by weight per unit length for the steel jacket with the balance consisting of the composite calcium/aluminum core. Steel contents higher than 85% result in a wire which is stiff and difficult to handle and which is excessively expensive to manufacture. Steel contents of less than 15% give insufficient protection to the calcium/aluminum core and do not permit the desired alloying of the calcium and aluminum to occur.

In accord with the present invention a cored wire product, with a diameter of approximately 8 millimeters (0.315 inches) was produced by the process described above. The product had solid calcium core with a diameter of 0.262 inches (6.65 millimeters), surrounded by an aluminum strip with a thickness of 0.010 inches (0.254 millimeters) and a mild steel jacket with a thickness of 0.010 inches (0.254 millimeters). The wire was produced in a continuous coil of sufficient length for further testing.

The wire produced was used to treat a heat of molten steel tapped from a furnace into a suitable ladle. The molten steel bath had an analysis, prior to wire injection, as follows: 0.06% carbon, 0.33% manganese, 0.008% sulfur, 0.009% phosphorous, 0.006% silicon, and 0.040% aluminum, balance essentially iron. Approximately 450 meters (1476 feet) of the wire was added to the steel ladle at a speed of 125 meters (410 feet) per minute. The composition of the wire was 50% steel, 37.5% calcium, and 12.5% aluminum by weight per unit of length, for a total addition of 20.3 kilograms of calcium, 6.7 kilograms of aluminum, and 27.0 kilograms of steel to the molten metal. After the injection, the analysis of the steel was as follows: 0.06% carbon, 0.33% manganese, 0.006% sulfur, 0.009% phosphorous, 0.008% silicon and 0.036% aluminum. The calcium content of the steel was analyzed to be 0.0041% by weight (41 ppm). The reactivity was judged to be within an acceptable limit for the operation and the heat was taken to a continuous caster and the entire heat cast successfully.

As stated above by using calcium and aluminum the vapor pressure of the calcium introduced into the steel bath is reduced and a quieter reaction is achieved. Because the surface to volume ratio is small for both the calcium rod as well as the aluminum strip, calcium recovery is higher and more reproducible then when using powdered calcium and powdered aluminum. The close contact achieved through the compression of the aluminum strip against the calcium rod during the roll forming operation permits effective heat transfer through the composite product and allows the calcium-aluminum alloy to form prior to the melting of the higher melting temperature steel jacket.

The cored wire according to the present invention reduces splashing caused by reactivity of the calcium in prior art compositions and thus the treatment can be more effective in all ladles, especially where the free board is limited. Cored wire according to the present invention minimizes problems caused by surface oxidation and hydration because of the low surface to volume ratio of the calcium core and the aluminum strip. The desired ratio of calcium to aluminum can be controlled to meet the desired composition without the problems caused by mixing powders of different densities and morphologies. Through proper selection of calcium wire diameter and aluminum strip width and gage, the problems caused by improper mixing of different powders can be avoided. The use of the aluminum jacket or sheath without also using a steel jacket has not been found to practical due to the low melting temperature and low strength of aluminum which do not permit effective injection into industrial size steel ladles. Without a steel protective jacket, the aluminum melts prior to forming the alloy with the calcium and the addition is not effective.

Thus it can be seen that a composite cored wire according to the present invention can be effectively used to introduce calcium into a molten steel bath where the addition of silicon to the steel is undesirable, the reactivity of pure calcium wire is unacceptable due to ladle free board or other factors, powder blends of calcium and aluminum give inconsistent results, shelf life of powdered calcium and aluminum are a concern, and higher recovery and lower treatment costs are desired.

Having thus illustrated and described our invention herein with reference to certain specific embodiments, the present invention is nevertheless not intended to be limited to the detail shown. Furthermore, various modifications may be made in the details within the scope of the invention that is desired to be protected by Letters Patent of the United States as defined in the appended claims.

What is claimed:

1. A cored wire for introducing reactive metals into a molten metal bath said cored wire comprising an outer jacket having a higher melting point then an inner core material, the inner core material being a composite of a first reactive metal surrounded by a sheath of a second reactive metal the first and second reactive metals melting at lower temperatures than the outer jacket to form an alloy prior to melting of the outer jacket, said outer jacket comprising a continuous lock seam longitudinally.

2. A cored wire for introducing a reactive metal into a bath of molten metal, said cored wire produced by:

extruding said reactive metal into an elongated wire having a generally cylindrical shape;

covering said reactive metal elongated wire with a layer of at least one second reactive metal to form a composite wire;

concurrently partially roll forming a sheath using a multi-step roll forming process, said sheath partially formed into a generally trough shaped member with peripheral edges having formed therein surfaces adapted to be mated and formed into a lock seam;

inserting said composite wire into said trough shaped portion of said partially formed sheath with said composite wire positioned to accommodate a lock seam to be formed in said sheath; and finishing said cored wire by further roll forming steps to close said sheath around said composite wire and forming a continuous lock seam in said sheath.

3. A cored wire according to claim 2 wherein said core wire is calcium metal.

4. A cored wire according to claim 2 wherein said sheath is a low carbon aluminum killed steel.

5. A cored wire according to claim 2 wherein said second reactive metal is aluminum.

6. A cored wire according to claim 2 wherein said second reactive metal is one of a composite of the second layer and a third layer of yet an additional reactive metal or a second layer being a composite of two or more different reactive metals.

* * * * *

UNITED STATES PATENT AND TRADEMARK OFFICE

CERTIFICATE OF CORRECTION

PATENT NO. : 6,346,135 B1
DATED : February 12, 2002
INVENTOR(S) : Phillip Ronald King et al.

It is certified that error appears in the above-identified patent and that said Letters Patent is hereby corrected as shown below:

Column 1,
Line 17, delete “have” and replace with -- has --

Signed and Sealed this

Twenty-first Day of January, 2003

JAMES E. ROGAN
*Director of the United States Patent and Trademark Office*